US012571153B2

(12) United States Patent
Kim et al.

(10) Patent No.: US 12,571,153 B2
(45) Date of Patent: Mar. 10, 2026

(54) CLOTHES TREATMENT APPARATUS

(71) Applicant: LG ELECTRONICS INC., Seoul (KR)

(72) Inventors: Naeun Kim, Seoul (KR); Youngho Kim, Seoul (KR); Jyeuk Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 100 days.

(21) Appl. No.: 18/716,815

(22) PCT Filed: Nov. 4, 2022

(86) PCT No.: PCT/KR2022/017251

§ 371 (c)(1),
(2) Date: Jun. 5, 2024

(87) PCT Pub. No.: WO2023/128228

PCT Pub. Date: Jul. 6, 2023

(65) Prior Publication Data

US 2025/0051991 A1 Feb. 13, 2025

(30) Foreign Application Priority Data

Dec. 28, 2021 (KR) ..... 10-2021-0189273

(51) Int. Cl.
*D06F 39/02* (2006.01)
*D06F 23/04* (2006.01)
(Continued)

(52) U.S. Cl.
CPC ..... *D06F 39/02* (2013.01); *D06F 23/04* (2013.01); *D06F 39/088* (2013.01); *D06F 39/12* (2013.01)

(58) Field of Classification Search
CPC ..... D06F 39/02
See application file for complete search history.

(56) References Cited

U.S. PATENT DOCUMENTS

| | | | |
|---|---|---|---|
| 5,870,906 | A | 2/1999 | Denisar |
| 2017/0037559 | A1 | 2/2017 | Gallagher et al. |
| 2020/0208328 | A1 | 7/2020 | Murphy |

FOREIGN PATENT DOCUMENTS

| | | | |
|---|---|---|---|
| CN | 113430790 | A | 9/2021 |
| KR | 10-2009-0101680 | A | 9/2009 |

(Continued)

*Primary Examiner* — Michael E Barr
(74) *Attorney, Agent, or Firm* — Birch, Stewart, Kolasch & Birch, LLP

(57) ABSTRACT

The present invention provides a clothes treatment apparatus. In one embodiment, a clothes treatment apparatus comprises: a cabinet forming an exterior and having an open upper side; a top cover provided on the top of the cabinet and having an inlet through which laundry can enter and exit; a door coupled to the top cover and opening and closing the inlet; a tub provided inside the cabinet and having a tub inlet communicating with the inlet; a drum provided inside the tub and accommodating clothes; a driving unit provided under the drum to rotate the drum; and a laundry detergent cartridge detachably provided on the top cover and storing a detergent for treating laundry, wherein the laundry detergent cartridge includes a body in which a storage space for storing the laundry detergent is formed, wherein a part of the bottom surface of the body is formed lower than other parts, wherein the lower part of the bottom surface has a discharge port and includes three or more protrusions that protrude downward from the body and extend to a lower position than the discharge port.

15 Claims, 10 Drawing Sheets

(51) Int. Cl.
*D06F 39/08* (2006.01)
*D06F 39/12* (2006.01)

(56) References Cited

FOREIGN PATENT DOCUMENTS

| | | | |
|---|---|---|---|
| KR | 10-2010-0066172 | A | 6/2010 |
| KR | 10-2011-0074239 | A | 6/2011 |
| KR | 10-2014-0065859 | A | 5/2014 |
| WO | WO 2023/108902 | A1 | 6/2023 |

【FIG. 1】
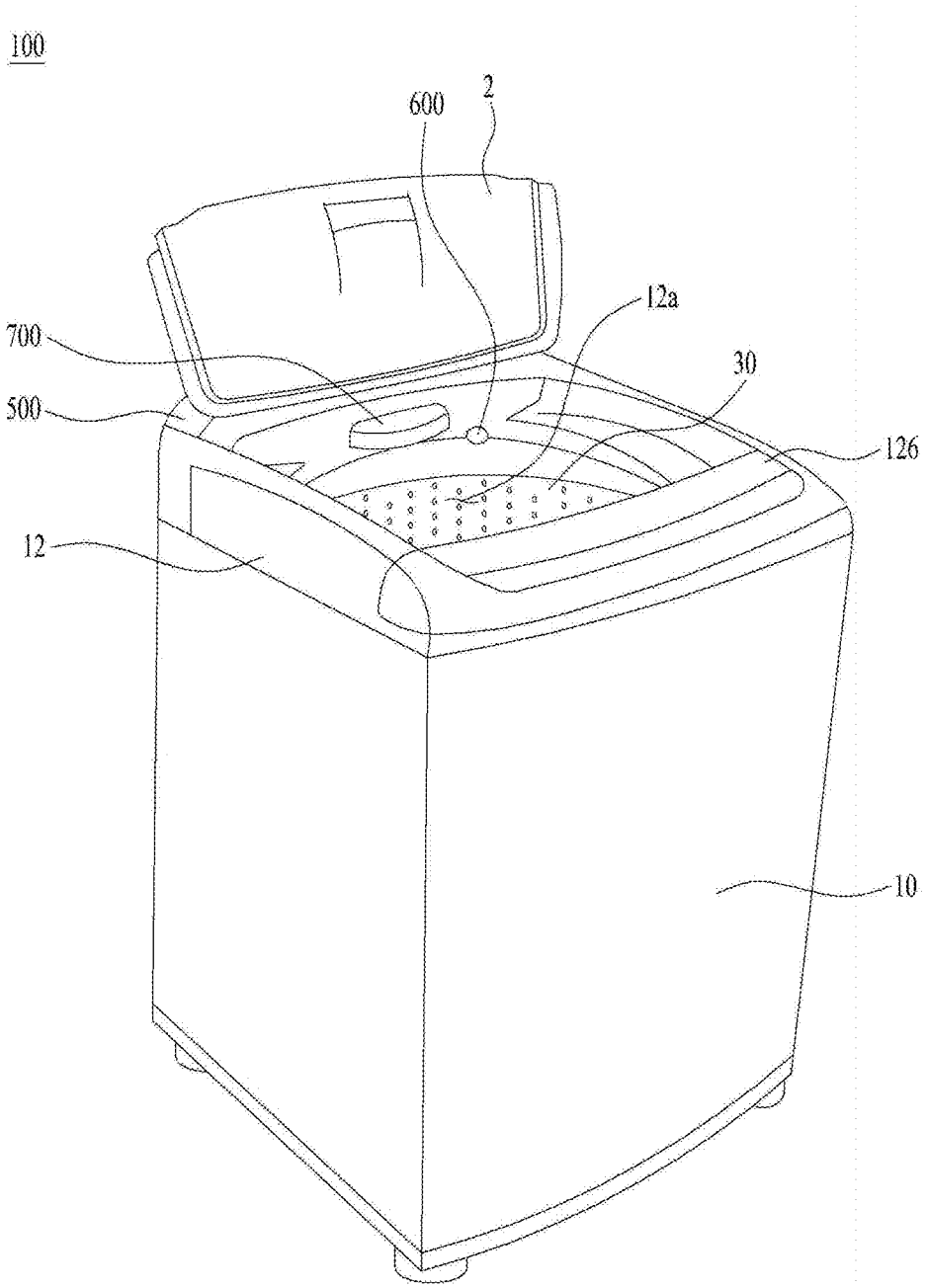

【FIG. 2】
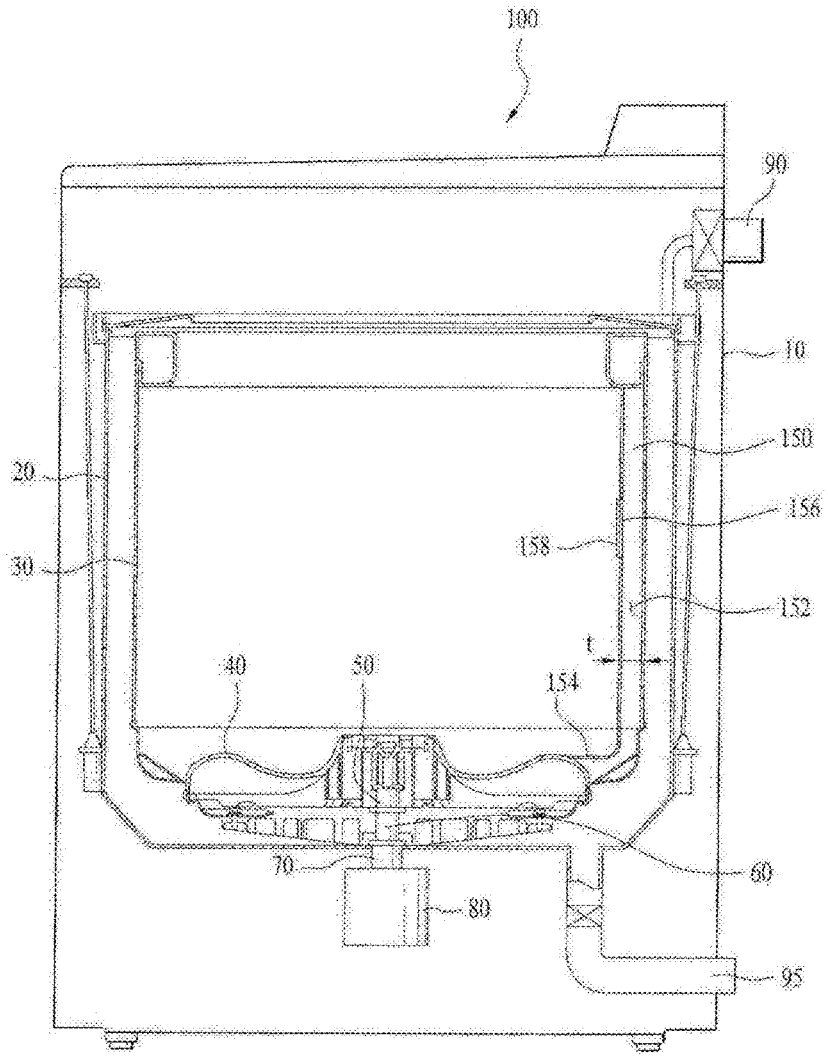

【FIG. 3】
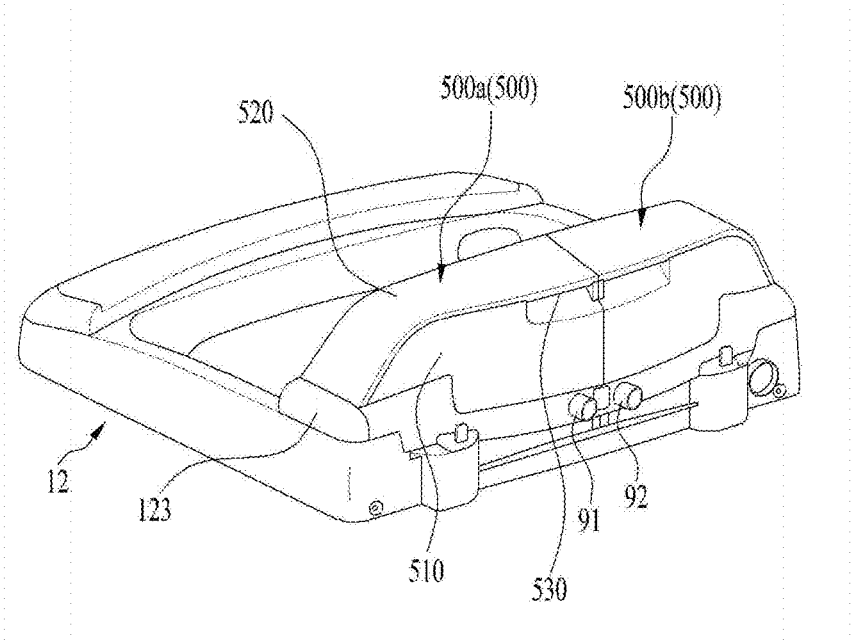
【FIG. 4】
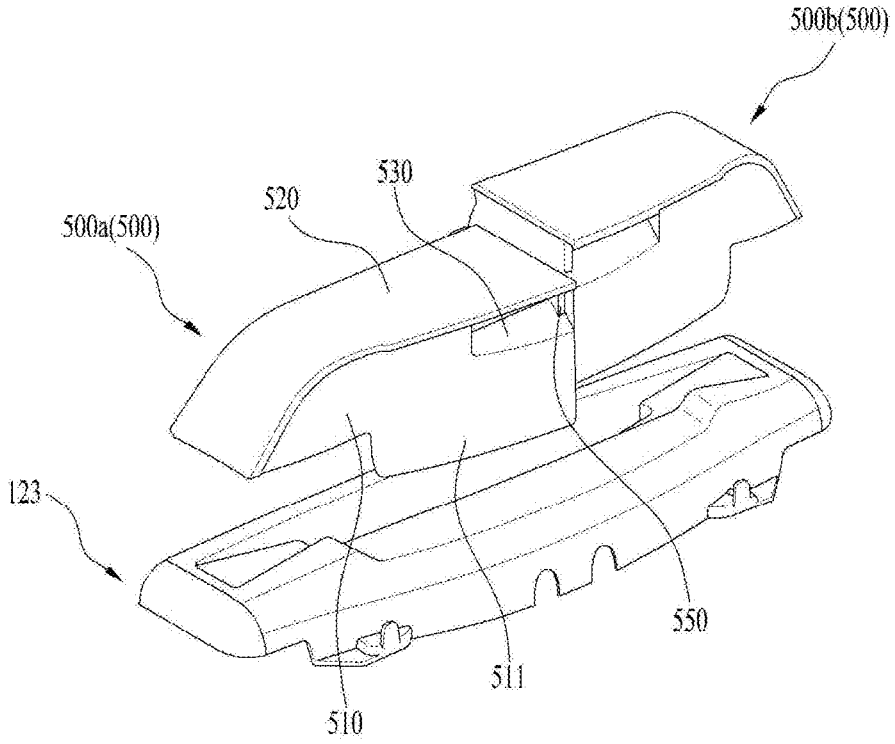

【FIG. 5】
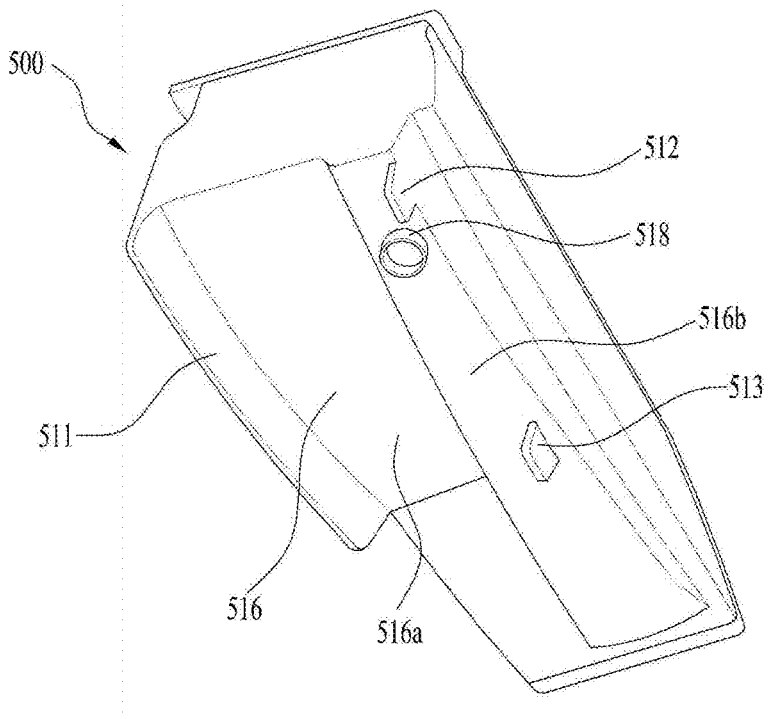
【FIG. 6】
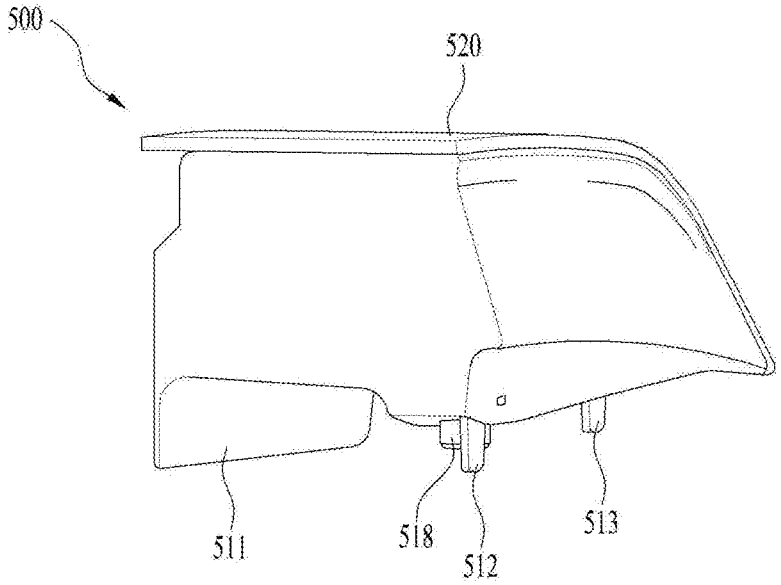

【FIG. 7】
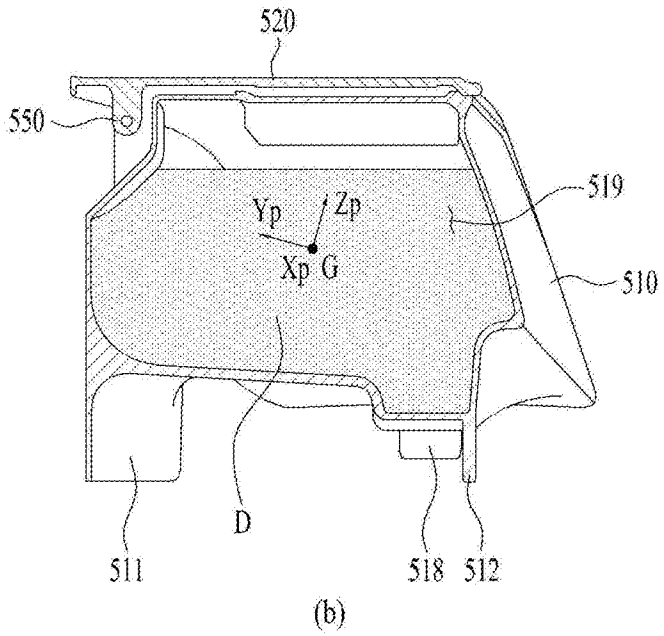
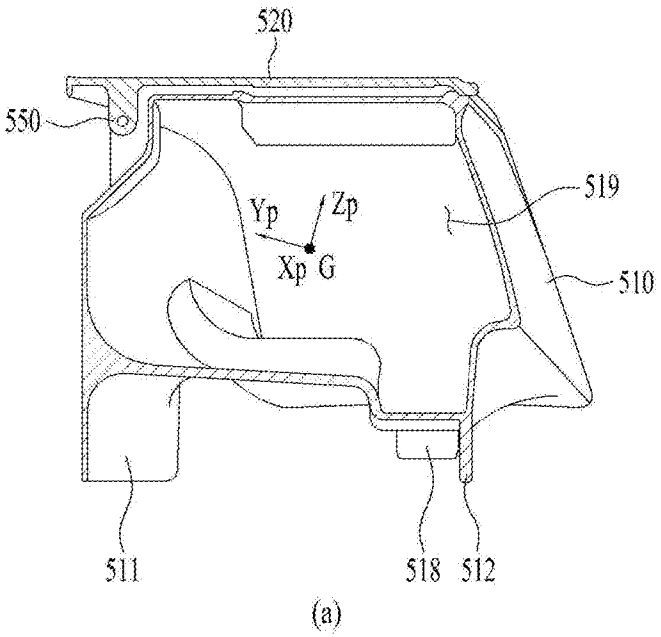

[FIG. 8]
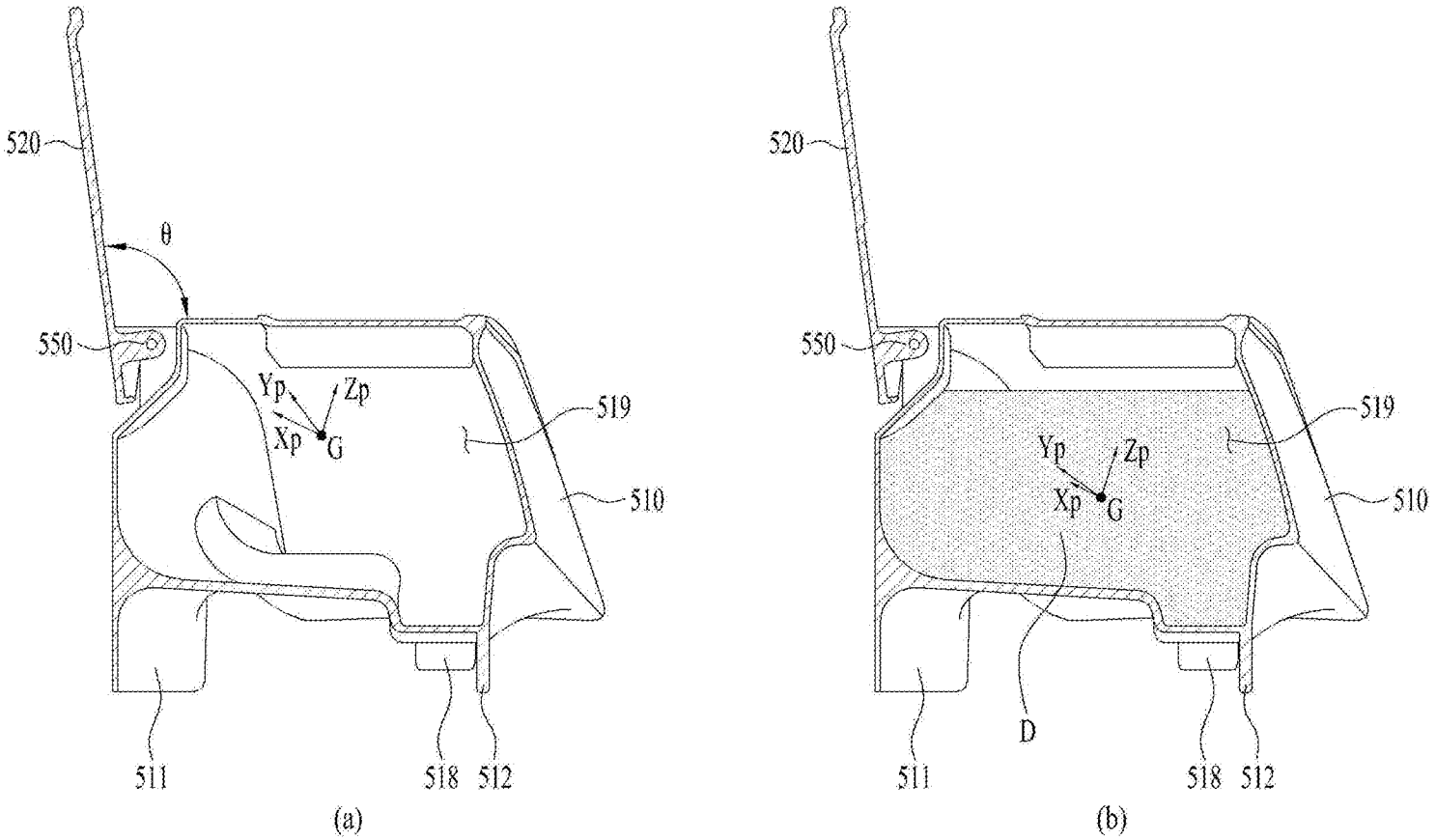

【FIG. 9】
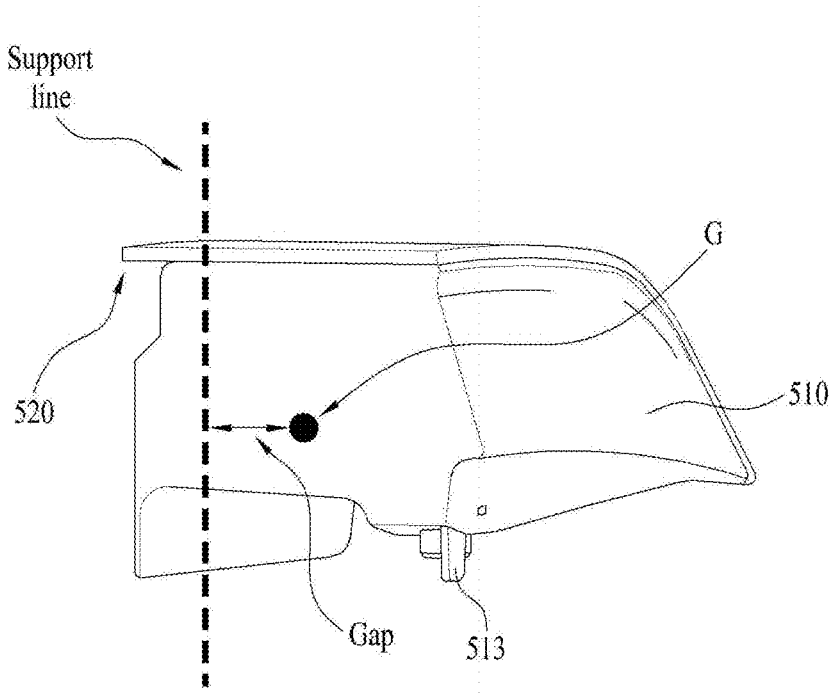

【FIG. 10】
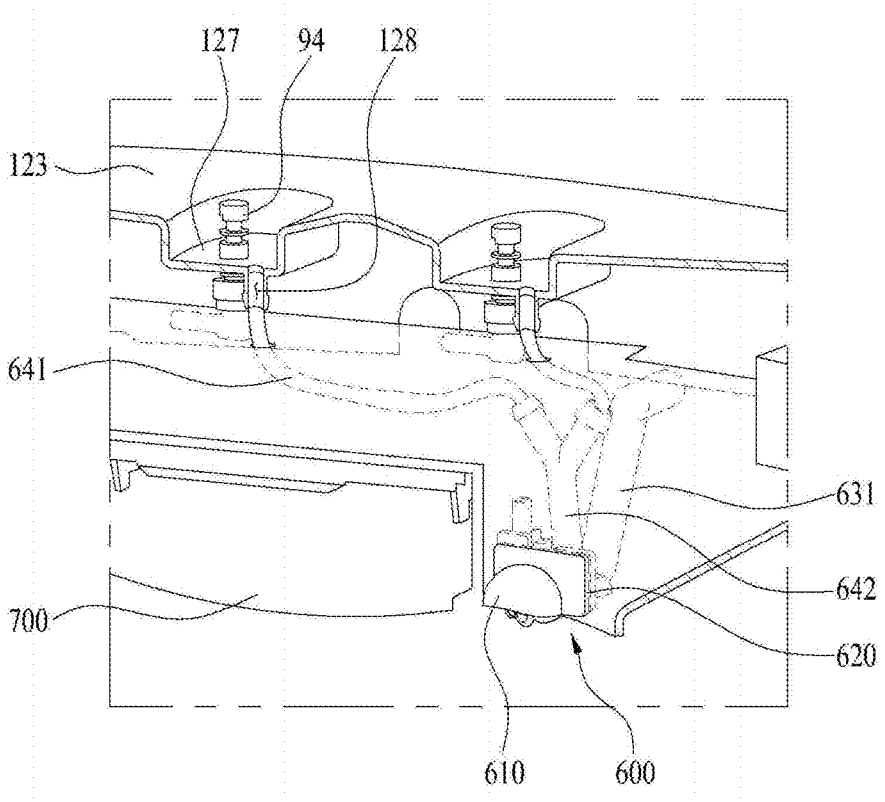

【FIG. 11】
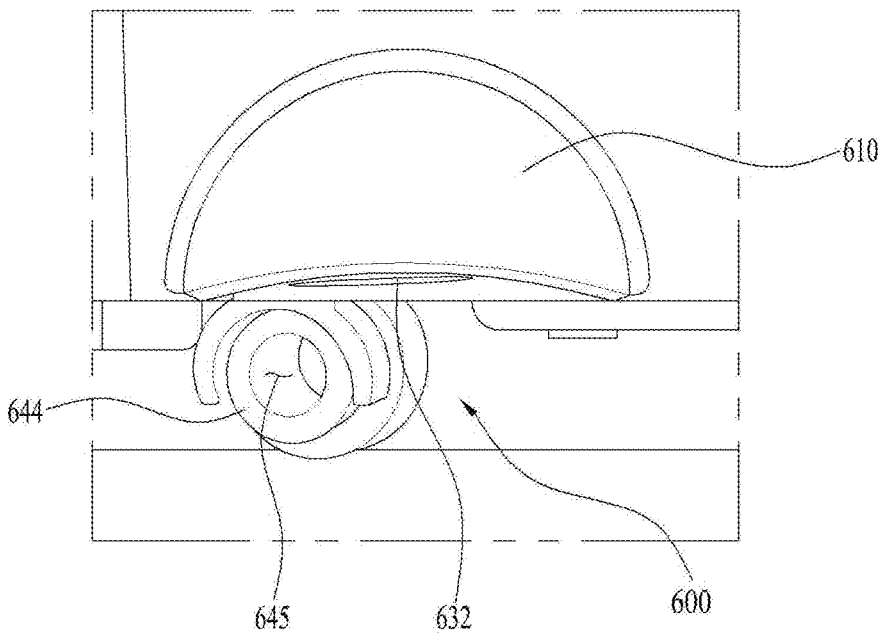

【FIG. 12】
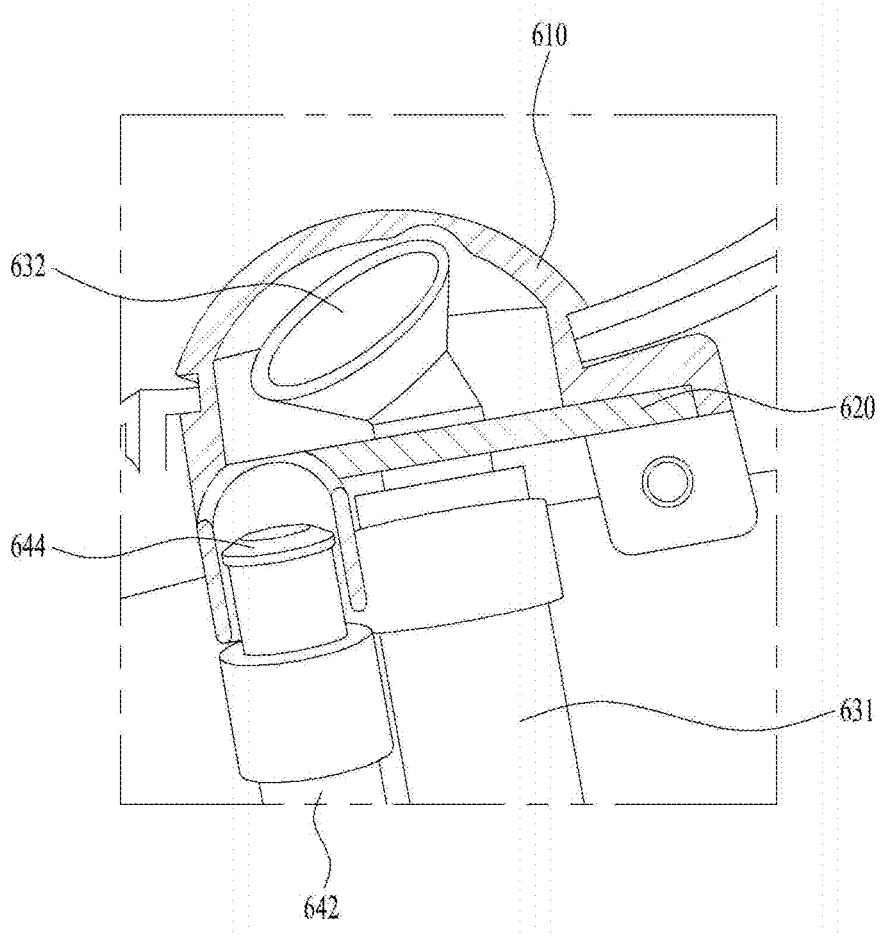

CLOTHES TREATMENT APPARATUS

CROSS REFERENCE TO RELATED APPLICATIONS

This application is the National Phase of PCT/KR2022/017251 filed on Nov. 4, 2022, which claims priority under 35 U.S.C. § 119 (a) to Patent Application No. 10-2021-0189273 filed in the Republic of Korea on Dec. 28, 2021, all of which are hereby expressly incorporated by reference into the present application.

TECHNICAL FIELD

The present disclosure relates to a laundry treating apparatus.

BACKGROUND

A laundry treating apparatus is an apparatus that puts clothes, bedding, and the like (hereinafter, referred to as laundry) into a drum to remove contaminations from the laundry. The laundry treating apparatus may perform processes such as washing, rinsing, dehydration, and drying. The laundry treating apparatuses may be classified into top loading-type laundry treating apparatuses and front loading-type laundry treating apparatuses.

The laundry treating apparatus is generally composed of a main body that forms an outer appearance thereof, a tub accommodated inside the main body, a drum that is rotatably mounted inside the tub and into which the laundry is put, and a detergent supply device that supplies detergent into the drum. When the drum is rotated by a motor in a state in which washing water has been supplied to the laundry accommodated in the drum, dirt on the laundry may be removed by friction between the drum and washing water.

The detergent supply device is equipped with a laundry detergent supply function of supplying the detergent or laundry detergent (hereinafter, referred to as 'laundry detergent') to improve a washing effect.

Here, the laundry detergent refers to a substance that enhances the washing effect, such as fabric detergent, fabric softener, and fabric bleach. The laundry detergent may be used in a powder form or in a liquid form.

In the existing laundry treating apparatus, for a user to supply the laundry detergent, a scheme of opening a door, then manually putting the laundry detergent into a detergent storage container installed inwardly of the door, and then allowing the laundry detergent directly injected by the user to pass through water supplied via a water supply flow channel to be put into the tub was mainly used, which is cumbersome.

US Patent Application Publication US 2020/0208328 A1 discloses a top loading-type laundry treating apparatus including a detergent supply device. In the detergent supply device of the prior art, a cartridge is located at a lower portion of the detergent supply device. Because of a structure of the laundry treating apparatus that injects the detergent and the softener from the top, the prior art includes a detergent supply pump that provides a pump pressure to supply the detergent of the cartridge. Additionally, as the detergent supply device is located at the lower portion of the laundry treating apparatus, a higher pump pressure is required to supply the detergent. In addition, because of a nature of the detergent, deposition and solidification are repeated, so that it is necessary to clean the inside of the cartridge and surroundings thereof when the detergent supply device is used for a long time. However, as in the prior art, the structure in which the cartridge is embedded in the laundry treating apparatus makes cleaning difficult. Additionally, because the detergent needs to be refilled, there is a need from a user's perspective to check a remaining amount of the detergent in real time, but when the cartridge is disposed at the lower portion of the laundry treating apparatus, this need is not able to be met.

SUMMARY

Technical Problem

The present disclosure is to provide a laundry detergent cartridge that is detachable from a top loading-type washing machine.

The present disclosure is to provide a laundry treating apparatus that includes a laundry detergent cartridge that is able to stand on its own and thus improves a user's convenience.

The present disclosure is to provide a laundry treating apparatus including a laundry detergent cartridge that may check a remaining amount of laundry detergent in real time.

The present disclosure is to provide a laundry detergent cartridge and a laundry treating apparatus that are easy to clean.

The present disclosure is to provide a laundry treating apparatus in which a laundry detergent cartridge is located at an upper portion of a laundry treating apparatus to increase a convenience of use.

Problems that the present disclosure is to solve are not limited by as described above, and other problems not mentioned will be clearly understood by those skilled in the art from a description below.

Technical Solutions

The present disclosure provides a laundry treating apparatus. The laundry treating apparatus includes a cabinet forming an outer appearance of the laundry treating apparatus and having an open top surface, a top cover disposed at a top of the cabinet and having a laundry inlet, wherein laundry enters and exits through the laundry inlet, a door that is coupled to the top cover and opens and closes the laundry inlet, a tub disposed inside the cabinet and having a tub inlet in communication with the laundry inlet, a drum that is disposed inside the tub and accommodates the laundry therein, a driver that is disposed under the drum and rotates the drum, and a laundry detergent cartridge that is detachable from the top cover and stores laundry detergent to treat the laundry, the laundry detergent cartridge includes a body having a storage space defined therein for storing the laundry detergent, a discharge port is formed at a portion of a bottom surface of the body, wherein a vertical level of the portion is lower than a vertical level of another portion of the bottom surface, and the laundry detergent cartridge includes three or more protrusions protruding downward from the body and extending to a vertical level lower than the vertical level of the discharge port.

In one implementation, a cartridge seating portion where the laundry detergent cartridge is seated may be formed in the top cover rearward of the door.

In one implementation, a connector connected to a water supply may be formed on the cartridge seating portion, and when the laundry detergent cartridge is seated on the cartridge seating portion, the connector may be coupled with the discharge port to define a discharge path connecting the storage space with the water supply.

In one implementation, the cartridge seating portion may be formed in a shape corresponding to a shape of a bottom surface of the laundry detergent cartridge.

In one implementation, one of the three or more protrusions may have a width greater than widths of the other two or more protrusions.

In one implementation, one of the three or more protrusions may be formed on one side and the other two or more protrusions may be formed on the other side, and the one may have a width greater than widths of the other two or more protrusions.

In one implementation, the laundry detergent cartridge may further include a cover covering an opening of the body, and the cover may be hinge-coupled to the body at a hinge coupling portion.

In one implementation, the cover may open by pivoting rearwards around the hinge coupling portion.

In one implementation, a handle may be formed at a rear side of the laundry detergent cartridge.

In one implementation, the handle may be formed by being recessed in a rear side of the body.

In one implementation, the laundry detergent cartridge may further include a cover covering an opening of the body, and the cover and the body may be hinge-coupled with each other at a side wall of the handle.

In one implementation, a recessed groove may be defined in the cartridge seating portion, and the connector may be disposed in the groove.

In one implementation, a hole may be defined in the groove, and the hole may be connected to a drain nozzle disposed to face the drum via a hose.

In one implementation, the drain nozzle may be coupled to a bracket where a spray nozzle is formed.

In one implementation, a portion or an entirety of the body may be transparent, allowing an amount of the laundry detergent stored in the storage space to be checked.

Advantageous Effects

According to an embodiment of the present disclosure, the laundry detergent cartridge that is detachable from the top loading-scheme washing machine may be obtained.

As the laundry detergent cartridge according to an embodiment of the present disclosure is able to stand on its own, the user's convenience is great.

According to the laundry detergent cartridge according to an embodiment of the present disclosure, the remaining amount of the laundry detergent may be checked in real time.

According to an embodiment of the present disclosure, the laundry detergent cartridge and the laundry treating apparatus may be easily cleaned.

According to an embodiment of the present disclosure, as the laundry detergent cartridge is located at the upper portion of the laundry treating apparatus, the convenience of use is great.

Effects of the present disclosure are not limited to the effects described above, and effects not mentioned may be clearly understood by those skilled in the art from the present document and the accompanying drawings to which the present disclosure pertains.

BRIEF DESCRIPTION OF THE DRAWINGS

FIG. 1 is a perspective view showing an outer appearance of a laundry treating apparatus according to an embodiment of the present disclosure.

FIG. 2 is a cross-sectional view for illustrating a structure of a laundry treating apparatus according to an embodiment of the present disclosure.

FIG. 3 is a rear perspective view of a top cover according to an embodiment of the present disclosure.

FIG. 4 is a perspective view showing a laundry detergent cartridge separated from a cartridge seating portion.

FIG. 5 is a bottom perspective view of a laundry detergent cartridge.

FIG. 6 is a view showing a front surface and a side surface of a laundry detergent cartridge.

FIG. 7 illustrates a structure in which a laundry detergent cartridge stands on its own when a cover is closed.

FIG. 8 illustrates a structure in which a laundry detergent cartridge stands on its own when a cover is opened.

FIG. 9 illustrates a self-standing structure of a laundry detergent cartridge according to an embodiment of the present disclosure.

FIG. 10 is a diagram illustrating a cartridge seating portion according to an embodiment of the present disclosure.

FIG. 11 is an enlarged view of a spray.

FIG. 12 is a bottom view of a spray.

BEST MODE

Hereinafter, a preferred embodiment of the present disclosure will be described in detail with reference to the accompanying drawings. A configuration of a device or a method for controlling the same to be described below is only for describing an embodiment of the present disclosure, not for limiting the scope of the present disclosure, and reference numerals used the same herein refer to the same components.

Specific terms used herein are only for convenience of description and are not used as a limitation of the illustrated embodiment.

For example, expressions indicating that things are in the same state, such as "same", "equal", "homogeneous", and the like, not only indicate strictly the same state, but also indicate a state in which a tolerance or a difference in a degree to which the same function is obtained exists.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

For example, expressions indicating a relative or absolute arrangement such as "in a certain direction", "along a certain direction", "parallel", "orthogonal", "central", "concentric", "coaxial", or the like not only strictly indicate such arrangement, but also indicate a state in which a relative displacement is achieved with a tolerance, or an angle or a distance that achieves the same function.

In order to describe the present disclosure, the description below will be achieved on the basis of a spatial orthogonal coordinate system with an X-axis, a Y-axis, and a Z-axis orthogonal to each other. Each axial direction (an X-axis direction, a Y-axis direction, or a Z-axis direction) means both directions in which each axis extends. Adding a '+' sign in front of each axial direction (a +X-axis direction, a +Y-axis direction, or a +Z-axis direction) means a positive direction, which is one of the two directions in which each axis extends. Adding a '−' sign in front of each axial direction (a −X-axis direction, a −Y-axis direction, or a −Z-axis direction) means a negative direction, which is the other of the two directions in which each axis extends.

Expressions referring to directions such as "front (+Y)/rear (−Y)/left (+X)/right (−X)/up (+Z)/down (−Z)" to be mentioned below are defined based on a XYZ coordinate axis. However, this is to describe the present disclosure such that the present disclosure may be clearly understood. In one example, each direction may be defined differently depending on the standard.

The use of terms such as 'first, second, third' in front of the components to be mentioned below is only to avoid confusion of the components referred to, and is independent of the order, importance, or master-slave relationship between the components. For example, an invention including only the second component without the first component may also be implemented.

Singular expressions used herein include plural expressions unless the context clearly dictates otherwise.

In addition, herein, the term 'and/or' includes a combination of a plurality of listed items or any of the plurality of listed items. Herein, 'A or B' may include 'A', 'B', or 'both A and B'.

In the present description, 'front' refers to a front side of a laundry treating apparatus, and 'rear' refers to a rear side of the laundry treating apparatus.

FIG. 1 is a perspective view showing an outer appearance of a laundry treating apparatus 100 according to an embodiment of the present disclosure. Referring to FIG. 1, the laundry treating apparatus 100 according to an embodiment will be described.

The laundry treating apparatus 100 includes a cabinet 10 with a top cover 12 installed on an open top surface thereof to form an outer appearance, and a drum 30 that accommodates laundry therein.

A laundry inlet 12*a* is defined in the top cover 12 to allow the laundry to enter and exit the drum 30. A door 125 opens and closes the laundry inlet 12*a*. The door 125 is installed on the top cover 12.

A control panel 126 is installed at a front side of the top cover 12. The control panel 126 has various buttons necessary for operation of the laundry treating apparatus 100, a display that displays an operation state and an input state, and the like. The control panel 126 receives a washing function input from a user or displays a washing progress state and informs a user of the same.

A laundry detergent cartridge 500 is located at an upper rear side of the top cover 12. The laundry detergent cartridge 500 will be described in detail later.

FIG. 2 is a cross-sectional view for illustrating a structure of the laundry treating apparatus 100 according to an embodiment of the present disclosure. With reference to FIG. 2, the laundry treating apparatus 100 according to an embodiment will be described. The laundry treating apparatus 100 includes the cabinet 10 that forms the outer appearance, a tub 20 installed inside the cabinet 10, and the drum 30 rotatably installed inside the tub 20 and used for washing and dehydrating.

The tub 20 is accommodated and disposed inside the cabinet 104. The tub 20 provides a space where water is stored. The tub 20 may receive water via a water supply 90 and store water therein.

The drum 30 provides a space where the laundry is stored. The drum 30 may be rotatably disposed inside the tub 203. Multiple through-holes that allow water inside the tub 20 to flow into the drum 30 are defined in a side wall of the drum 30.

Inside the drum 30, a pulsator 40 that may rotate independently or together with the drum 30 is installed. The pulsator 40 is connected to a washing shaft 50. A dehydration shaft 60 is coupled to the washing shaft 50. The washing shaft 50 and the dehydration shaft 60 are connected to a driver 80. The driver 80 may be provided as a motor. The washing shaft 50 and the dehydration shaft 60 may rotate by a rotational force of the driver 80. A clutch 70 allows the washing shaft 50 and the dehydration shaft 60 to rotate independently or together. That is, the clutch 70 may rotate the washing shaft 50 so that only the pulsator 40 rotates without rotating the drum 30, or may rotate the dehydration shaft 60 so that the drum 30 and the pulsator 40 rotate together. The laundry treating apparatus 100 according to an embodiment is controlled such that the drum 30 and/or the pulsator 40 rotates when washing or rinsing an object-to-be-washed, and only the drum 30 rotates during dehydration.

The water supply 90 connected to an external water supply source for water supply is disposed above the drum 30. The water supply 90 includes a water supply pipe 91 and 92 (see FIG. 4) connected to the external water supply source. The water supply 90 may include a water supply valve (not shown) that adjusts a flow rate of water by adjusting an opening degree of the water supply pipe 91 and 92. The water supply pipe 91 and 92 may be divided into a cold water pipe 91 and a hot water pipe 92.

A drain pipe 95 for draining washing water is disposed at one side beneath the tub 20 and is connected to the outside of the cabinet 10. Water stored in the tub 20 is discharged to the outside of the cabinet 10 via the drain pipe 95.

A filter assembly 150 may be disposed on a side wall of the drum 30. The filter assembly 150 may be disposed along the side wall of the drum 30, and may have a circulation flow channel 152 through which washing water circulates defined therein. The filter assembly 150 may have an inlet 154 into which washing water is introduced at a lower side thereof and an outlet 156 from which washing water is discharged at a central side thereof. The outlet 156 of the filter assembly 150 may have a filter 158 that filters washing water. Accordingly, washing water introduced into the filter assembly 150 from a lower side of the drum 30 may rise along the circulation flow channel 152 as the drum 30 rotates, and then may be supplied back into the drum 30 via the filter 158.

FIG. 3 is a rear perspective view of the top cover 12 according to an embodiment of the present disclosure. Referring to FIG. 3, the laundry detergent cartridge 500 located at the rear side of the top cover 12 will be described.

The laundry detergent cartridge 500 may include a first laundry detergent cartridge 500*a* and a second laundry detergent cartridge 500*b*. The first laundry detergent cartridge 500*a* is for accommodating detergent therein. The second laundry detergent cartridge 500*b* is for accommodating fabric softener therein. The first laundry detergent cartridge 500*a* and the second laundry detergent cartridge 500*b* are seated on a cartridge seating portion 123 of the top cover 12.

A structure of the first laundry detergent cartridge 500*a* and a structure of the second laundry detergent cartridge 500*b* are the same except that they are symmetrical to each other. A description of one laundry detergent cartridge 500 replaces respective descriptions of the first laundry detergent cartridge 500*a* and the second laundry detergent cartridge 500*b*.

The laundry detergent cartridge 500 includes a body 510 and a cover 520. The laundry detergent cartridge 500 is located at an upper rear side of the top cover 12 and is exposed to the user.

The body 510 defines a storage space 519 (see FIG. 7) in which laundry detergent is accommodated. In the present document, the laundry detergent collectively refers to the detergent and the fabric softener. The body 510 may be partially or entirely made of a transparent material. Via a transparent portion of the body 510, the user may check a remaining amount of the laundry detergent contained in the body 510.

The cover 520 covers an upper portion of the body 510. An opening is defined in the upper portion of the body 510. The cover 520 opens and closes the opening of the body 510. The laundry detergent is accommodated in the storage space via the opening of the body 510. The user may open the cover 520, then fill the storage space 519 of the body 510 with the laundry detergent, and then close the storage space 519 by covering the cover 520.

A handle 530 is defined at a rear side of the laundry detergent cartridge 500. The handle 530 is defined by recessing a rear side of the body 510. For example, the handle 530 may be defined via a combination of the cover 520 and the recessed body 510. The handle 530 may be composed of the cover 520 exposed by the recessed body 510. The user may separate the laundry detergent cartridge 500 from the cartridge seating portion 123 by holding an exposed bottom surface of the cover 520 with a hand and lifting the laundry detergent cartridge 500 upward. As the handle 530 is located at the rear side of the laundry detergent cartridge 500, the user may pull the laundry detergent cartridge 500 inward toward a user's body and lift the same upward, allowing the laundry detergent cartridge 500 to be stably separated. For example, an accident in which the laundry detergent cartridge 500 falls rearward of the laundry treating apparatus 100 while the laundry detergent cartridge 500 is being separated may be prevented.

FIG. 4 is a perspective view showing the laundry detergent cartridge 500 separated from the cartridge seating portion 123. A description will be made with reference to FIG. 4.

The laundry detergent cartridge 500 according to an embodiment is detachable in a vertical direction with respect to the cartridge seating portion 123. In other words, the laundry detergent cartridge 500 is coupled to the cartridge seating portion 123 in a downwardly mounted form. The first laundry detergent cartridge 500*a* and the second laundry detergent cartridge 500*b* may be detached independently. As the laundry detergent cartridge 500 may be separated from the cartridge seating portion 123, the user may conveniently refill the laundry detergent into the laundry detergent cartridge 500. Additionally, the laundry detergent cartridge 500 may be conveniently washed.

The cover 520 is hinged to the body 510. A hinge coupling portion 550 is provided at a rear top of the body 510. The hinge coupling portion 550 may be provided in the handle 530. The handle 530 is defined to be recessed inward from the body 510. The hinge coupling portion 550 may be provided on a side wall formed by the recession. The cover 520 may pivot around the hinge coupling portion 550. As the hinge coupling portion 550 is located at the rear side of the body 510, the cover 520 pivots rearwards and opens. Therefore, when the user holds the handle 530 and separates the laundry detergent cartridge 500 from the cartridge seating portion 123, the cover 520 may be prevented from opening.

The cartridge seating portion 123 forms a rear top surface of the top cover 12. The cartridge seating portion 123 is formed in a shape corresponding to a bottom surface of the laundry detergent cartridge 500.

FIG. 5 is a bottom perspective view of the laundry detergent cartridge 500. Referring to FIG. 5, the bottom surface of the laundry detergent cartridge 500 will be described.

A bottom surface 516 of the laundry detergent cartridge 500 has a portion located at a lower vertical level than another portion. In FIG. 5, the bottom surface 516 is indicated and described based on a case of viewing the laundry detergent cartridge 500 from outside, but the bottom surface 516 is defined as a bottom surface defining the storage space 519 (see FIG. 7) in the body 510. The bottom surface 516 is defined as a bottom surface of a portion where the laundry detergent accommodated in the laundry detergent cartridge 500 and the body 510 are in contact with each other.

In the bottom surface of the laundry detergent cartridge 500, a second surface 516*b* is formed at a lower vertical level than a first surface 516*a*. Because the second surface 516*b* is formed to be more recessed than the first surface 516*a*, the laundry detergent accommodated in the storage space 519 is collected toward the second surface 516*b*. A discharge port 518 is formed on the second surface 516*b*. The laundry detergent stored in the storage space 519 is discharged to the outside of the laundry detergent cartridge 500 via the discharge port 518.

The laundry detergent cartridge 500 includes protrusions 511, 512, and 513 that protrude downward from the body 510. Three or more protrusions 511, 512, and 513 are formed. The protrusions 511, 512, and 513 extend to a vertical level lower than that of the discharge port 518. In an embodiment, the protrusions 511, 512, and 513 may include a first rib 511, a second rib 512, and a third rib 513. The first rib 511 may be formed at one side of the bottom surface 516, and the second rib 512 and the third rib 513 may be formed at the other side of the bottom surface 516. The first rib 511 is formed at a rear side. The second rib 512 and the third rib 513 are formed at a front side. The first rib 511 may be formed at a location facing the second rib 512 and the third rib 513. A width of the first rib 511 is greater than those of the second rib 512 and the third rib 513.

FIG. 6 is a view showing a front surface and a side surface of the laundry detergent cartridge 500. A description will be made with reference to FIG. 6. The present disclosure has a three-point support structure. The first rib 511, the second rib 512, and the third rib 513 support the laundry detergent cartridge 500 at 3 points. The laundry detergent cartridge 500 may stand on its own because of the three-point support structure. As the laundry detergent cartridge 500 may stand on its own, the user may conveniently fill the laundry detergent into the laundry detergent cartridge 500. In other words, a user convenience increases as the laundry detergent cartridge 500 may be filled with the laundry detergent while standing on its own.

FIG. 7 illustrates a structure in which the laundry detergent cartridge 500 stands on its own when the cover 520 is closed. In (a), the storage space 519 is empty, and in (b), the storage space 519 is filled with the laundry detergent D. G represents a center of gravity. According to an embodiment of the present disclosure, when the cover 520 is closed, the center of gravity G is located inwardly of the three-point support structure.

FIG. 8 illustrates a structure in which the laundry detergent cartridge 500 stands on its own when the cover 520 is opened. In (a), the storage space 519 is empty, and in (b), the storage space 519 is filled with the laundry detergent D. G represents the center of gravity. The cover 520 may be opened with an angle equal to or greater than a first angle θ. The first angle θ may be equal to or greater than 90 degrees. According to an embodiment of the present disclosure, when the cover 520 is open, the center of gravity G is located inwardly of the three-point support structure. Therefore, even when the user opens the cover 520, the laundry detergent cartridge 500 does not fall and stands on its own.

FIG. 9 illustrates a self-standing structure of the laundry detergent cartridge 500 according to an embodiment of the present disclosure. A description will be made with reference to FIG. 9. The above-mentioned center of gravity G is always located inwardly of a support line. When the center of gravity G deviates outwardly from the support line, the laundry detergent cartridge 500 is not able to stand on its own and falls down. According to an embodiment of the present disclosure, the center of gravity G is always located inwardly of the support line and stably stands on its own.

FIG. 10 is a diagram illustrating the cartridge seating portion 123 according to an embodiment of the present disclosure. A description will be made with reference to FIG. 10.

A recessed groove 127 is defined in the cartridge seating portion 123. A connector 94 is provided in the groove 127. When the laundry detergent cartridge 500 is seated on the cartridge seating portion 123, the connector 94 is coupled to the discharge port 518 of the laundry detergent cartridge 500. The connector 94 is connected to the water supply 90. The connector 94 is coupled to the discharge port 518 to define a discharge path connecting the storage space 519 of the laundry detergent cartridge 500 with the water supply 90.

A cleaning hole 128 is defined in the groove 127. The cleaning hole 128 is connected to a drain nozzle 644 in a spray 600 by a first hose 641. The spray 600 is disposed next to a manual detergent box 700. In an embodiment, the two first hoses 641 are combined into a second hose 642. The second hose 642 is connected to the drain nozzle 644.

FIG. 11 is an enlarged view of the spray 600. FIG. 12 is a bottom view of the spray 600. A description will be made with reference to FIGS. 11 and 12. The spray 600 is a component that sprays water toward the drum 30. Water sprayed via the spray 600 may be supplied at a higher pressure than a pressure at which it is generally supplied.

The spray 600 may be covered by a spray cover 610. A spray nozzle 632 is located in the spray 600. The spray nozzle 632 is connected to a third hose 631. The third hose 631 is connected to the water supply 90. The spray nozzle 632 receives water from the water supply 90 and sprays water into the drum 30. The spray 600 includes a bracket 620. The spray nozzle 632 is formed on the bracket 620. The bracket 620 may be coupled to the top cover 12. The drain nozzle 644 is coupled to the bracket 620.

The laundry detergent may leak during the process in which the discharge port 518 and the connector 94 are coupled to or separated from each other. The leaked laundry detergent may remain on a top surface of the cartridge seating portion 123. The remaining laundry detergent accumulates and causes contamination. The user needs to clean the accumulated contaminants. Residual water remaining in the groove 127 after the user cleans the contaminants is discharged via the cleaning hole 128 and discharged into the drum 30 via the drain nozzle 644. According to an embodiment of the present disclosure, the accumulated contaminants may not spread to other components because of the groove 127, and residual water remaining after cleaning the groove 127 and surroundings thereof may be easily discharged via cleaning hole 128, making the cleaning and management easy.

Although the present disclosure has been illustrated and described in relation to the specific embodiment, it will be self-evident to those with ordinary knowledge in the industry that various improvements and changes may be made to the present disclosure without departing from the technical spirit of the present disclosure provided by the following claims.

What is claimed is:

1. A laundry treating apparatus comprising:

a cabinet forming an outer appearance of the laundry treating apparatus and having an open top surface:

a top cover disposed at a top of the cabinet and having a laundry inlet, wherein laundry enters and exits through the laundry inlet:

a door coupled to the top cover and configured to open and close the laundry inlet:

a tub disposed inside the cabinet and having a tub inlet in communication with the laundry inlet:

a drum disposed inside the tub and configured to accommodate the laundry therein:

a driver disposed under the drum and configured to rotate the drum; and a laundry detergent cartridge detachable from the top cover and configured to store laundry detergent to treat the laundry, wherein the laundry detergent cartridge includes a body having a storage space defined therein for storing the laundry detergent, wherein a discharge port is formed at a portion of a bottom surface of the body, wherein a vertical level of the portion is lower than a vertical level of another portion of the bottom surface, wherein the laundry detergent cartridge includes three or more protrusions protruding downward from the body and extending to a vertical level lower than the vertical level of the discharge port.

2. The laundry treating apparatus of claim 1, wherein a cartridge seating portion where the laundry detergent cartridge is seated is formed in the top cover rearward of the door.

3. The laundry treating apparatus of claim 2, wherein a connector connected to a water supply is formed on the cartridge seating portion, wherein when the laundry detergent cartridge is seated on the cartridge seating portion, the connector is coupled with the discharge port to define a discharge path connecting the storage space with the water supply.

4. The laundry treating apparatus of claim 2, wherein the cartridge seating portion is formed in a shape corresponding to a shape of a bottom surface of the laundry detergent cartridge.

5. The laundry treating apparatus of claim 1, wherein one of the three or more protrusions has a width greater than widths of the other two or more protrusions.

6. The laundry treating apparatus of claim 5, wherein one of the three or more protrusions is formed on one side and the other two or more protrusions are formed on the other side, wherein the one has a width greater than widths of the other two or more protrusions.

7. The laundry treating apparatus of claim 1, wherein the laundry detergent cartridge further includes a cover covering an opening of the body, wherein the cover is hinge-coupled to the body at a hinge coupling portion.

8. The laundry treating apparatus of claim 7, wherein the cover opens by pivoting rearwards around the hinge coupling portion.

9. The laundry treating apparatus of claim 1, wherein a handle is formed at a rear side of the laundry detergent cartridge.

10. The laundry treating apparatus of claim 9, wherein the handle is formed by being recessed in a rear side of the body.

11. The laundry treating apparatus of claim 10, wherein the laundry detergent cartridge further includes a cover covering an opening of the body, and the cover and the body are hinge-coupled with each other at a side wall of the handle.

12. The laundry treating apparatus of claim 3, wherein a recessed groove is defined in the cartridge seating portion, and the connector is disposed in the groove.

13. The laundry treating apparatus of claim 12, wherein a hole is defined in the groove, and the hole is connected to a drain nozzle disposed to face the drum via a hose.

14. The laundry treating apparatus of claim 13, wherein the drain nozzle is coupled to a bracket where a spray nozzle is formed.

15. The laundry treating apparatus of claim 1, wherein a portion or an entirety of the body is transparent, allowing an amount of the laundry detergent stored in the storage space to be checked.

* * * * *